United States Patent [19]

Gueret

[11] Patent Number: 4,927,281

[45] Date of Patent: May 22, 1990

[54] BRUSH FOR APPLYING MASCARA AND CONTAINER

[75] Inventor: Jean-Louis Gueret, Paris, France

[73] Assignee: L'Oreal, Paris, France

[21] Appl. No.: 308,726

[22] Filed: Feb. 10, 1989

[30] Foreign Application Priority Data

Feb. 12, 1988 [FR] France ..... 88 01690

[51] Int. Cl.[5] ..... A46B 9/06; A46B 11/00

[52] U.S. Cl. ..... 401/129; 15/159 A; 15/206; 132/218

[58] Field of Search ..... 15/159 A, 206, 207; 401/118, 129; D4/131, 132, 134; 132/88.7, 85, DIG. 902, 218; D28/7

[56] References Cited

U.S. PATENT DOCUMENTS

| | | | |
|---|---|---|---|
| 2,433,325 | 12/1947 | Slaughter | 15/159 A |
| 3,121,040 | 2/1964 | Shaw | 161/177 |
| 3,312,994 | 4/1967 | Fassio | 15/159 A |
| 4,733,425 | 3/1988 | Hartel | 15/206 |
| 4,861,179 | 8/1989 | Schrepf | 132/218 |

FOREIGN PATENT DOCUMENTS

| | | |
|---|---|---|
| 0250680 | 1/1988 | European Pat. Off. . |
| 2125920 | 9/1972 | France . |

OTHER PUBLICATIONS

France–Search Report

*Primary Examiner*—Richard J. Johnson
*Attorney, Agent, or Firm*—Cushman, Darby & Cushman

[57] ABSTRACT

A brush for applying makeup includes a multitude of bristles wedged into the spirals (9) of at least two branches (10, 11) of a helically twisted metal wire, which form the core (12) of the brush. Over at least a portion of the brush, bristles (8*a*, 8*b*) are provided the surface of which has at least one groove extending substantially from the base to the tip, and the cross sections of the bristles have different shapes, of at least two types. As a result, the bristles (8*a*, 8*b*) having different cross-sectional shapes are spaced apart differently with respect to the mid-plane (14) of the spiral, and there is a space (15) between the bristles to permit penetration of the eyelashes (16) or hair.

13 Claims, 1 Drawing Sheet

BRUSH FOR APPLYING MASCARA AND CONTAINER

FIELD OF THE INVENTION

The invention relates to a brush for applying a makeup product, in particular for applying mascara to the eyelashes or dye to the hair, of the type that includes a multitude of bristles wedged into the spirals of at least two branches of a helically twisted metal wire that forms the core of the brush.

BACKGROUND OF THE INVENTION

In brushes of this type, the bristles generally define a substantially helicoid nappe, and the ends of the bristles are arranged in the form of spirals. As a result, the brush does not fill homogeneously with the makeup product, nor can the eyelashes or hair easily penetrate to the interior of the nappe defined by the bristles of the brush. Because of this, the made-up eyelashes are often poorly separated and are instead joined in tufts; for more careful makeup, considerable time must be spent.

OBJECT AND SUMMARY OF THE INVENTION

The primary object of the invention is to furnish a brush for applying a makeup product of the type defined above that no longer, or to a lesser degree, has the above disadvantages and which in particular makes it possible to eliminate, or reduce considerably, the spiral effect or helicoidal nappe defined by the bristles.

According to the invention, a brush for applying a makeup product of the type defined above is characterized in that over at least part of the brush, bristles are provided that at the surface have at least one groove extending substantially from the base to the tip, and the cross sections of the groove take various forms, of at least two types, such that the bristles having forms of different cross section are spaced apart differently with respect to the mid-plane of the spiral, and that a space exists between these bristles, to permit penetration by the eyelids or hair, while the bristles of different cross section bring about different amounts of filling of the product along the brush.

Thus according to the invention the spiral effect is eliminated, or greatly diminished, at least in the aforementioned portion of the brush, and the eyelashes can be made up differently over the length of the eye.

The brush is preferably provided over its entire length with bristles the cross sections of which are of different forms, being of at least two types.

The bristles having cross sections of different forms are also made of different materials. The at least two forms of different cross sections are selected advantageously from among the following forms: trelobal, tetralobal, pentalobal, C-shaped, I-shaped, H-shaped, or of oval cross section, provided with a groove toward each of the ends of the short axis of the cross section.

The areas of the cross sections of various shapes may themselves be different; in particular, bristles may be provided having a cross section with a larger area, these bristles being made of a material capable of softening when it is dipped into the product intended to be spread by the brush.

Because the bristle cross sections are varied in shape and because the dimensions of the cross sections and the material of the bristles may differ, zones of different flexion are created upon wiping, and hence a variable distribution of the product over the brush is obtained.

Because of the groove or grooves provided on each bristle, the distribution of the product on the bristle is relatively homogeneous from the base to the tip of the bristle.

The invention also relates to a makeup product container, equipped with a brush of the type defined above.

In addition to the above-described arrangements, the invention comprises a number of other arrangements exemplary embodiments of which will be described in greater detail below, in conjunction with the drawings, but it will be understood that these exemplary embodiments do not limit the scope of the invention in any manner.

DESCRIPTION OF THE PREFERRED EMBODIMENTS

Figure 1:
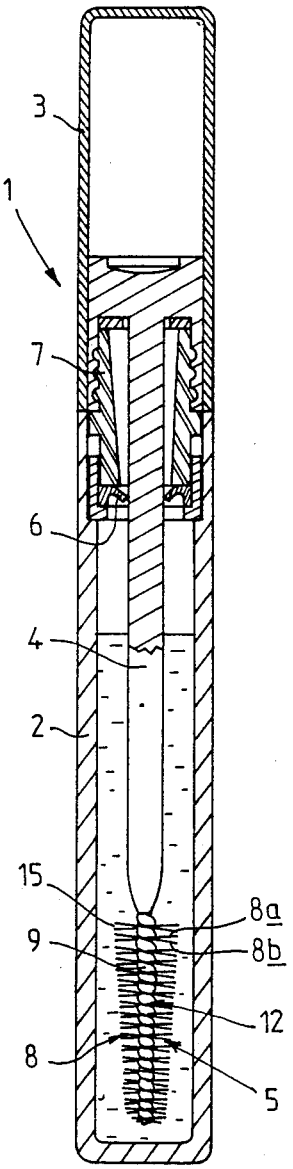
FIG. 1 is a view in axial section of a brush for applying a makeup product according to the invention, placed in the product container.

Turning now to FIG. 1, a mascara applicator assembly 1 can be seen, including a container 2 that cotains a product of liquid to pasty consistency. This container is topped by a cap 3, to which a rod 4 is connected that carries a brush 5 for applying the makeup product. A circular wiping lip 6 of flexible material is provided in the vicinity of an introduction passage 7.

The brush 5 includes a multitude of bristles 8 (see FIGS. 1 and 9) wedged in the spirals 9 of two branches 10, 11 of a metal wire, twisted in a helix and forming the core 12 of the brush.

For making the brush 5, the branches 10 and 11 are typically initially formed by the parallel rectilinear branches of a U obtained by bending a metal wire 180°, in particular an iron wire. The bristles 8 are placed between the rectilinear branches 10 and 11 along a nappe located in the plane that is substantially orthogonal to the plane of the branches 10 and 11; these branches are then twisted, as shown in FIGS. 1 and 9, so that between them they imprison the bristles 8, the mid-portion of which is wedged between the spirals of the two branches 10 and 11.

In a brush of the standard type, the bristles 8 are distributed, after twisting of the branches 10 and 11, in a helicoid nappe, being braced relatively against one another along a direction substantially parallel to the axis of the core 12. As a result, as explained above, a spiral effect is brought about, which is disadvantageous for makeup purposes and prevents the penetration of the eyelashes of hair into the nappe between the bristles.

To overcome this disadvantage, over at least a portion of the brush, bristles **8*a*, 8*b* (FIG. 9) are provided, the cross sections of which have different forms, of at least two types, preferably selected from among the shapes represented in FIGS. 2–8; the bristles are also provided on the surface with at least one groove or channel 13 (FIGS. 2–8) that extends substantially from the base of the bristle, in other words from the core 12**, to the tip of the bristle.

Figure 9:
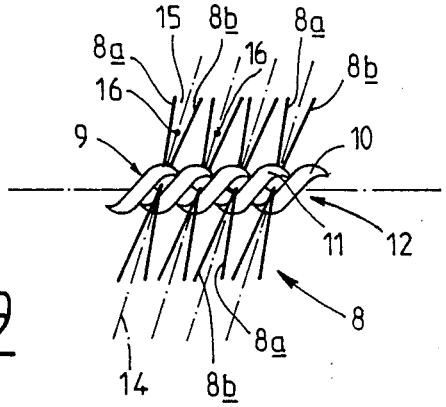
FIG. 9 is a schematic view on a larger scale of a portion of the brush according to the invention.

These bristles 8*a*, 8*b* behave differently when the branches 10 and 11 are twisted, and are spaced apart differently, as shown in FIG. 9, with respect to the mid-plane 14 of the spiral, because their cross sections are of different shapes. The bristles 8*a*, 8*b* do not form a single nappe, and a space 15 is left between the bristles, which allows an eyelash 16 (schematically shown), or a hair to penetrate into the space.

Figure 2:
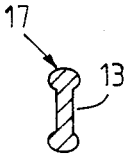
FIGS. 2–8 show various cross-sectional forms, from among which at least two different forms are selected for the bristles of the brush according to the invention.
Figure 3:
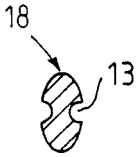

Preferably, the brush 5 is provided over its entire length with bristles 8*a*, 8*b* of different shaped cross sections, such that the spaces, such as 15, are located over the entire length of the brush. The shapes of the cross sections of the bristle 8*a*, 8*b* are advantageously selected from among the group of shapes shown in FIGS. 2–8. FIG. 2 corresponds to a shape 17 in the form of a I, which has serifs at each end and includes some kind of groove 13 on each side between the serifs. In this example, the depth of the groove is slight in proportion to its width. FIG. 3 shows an oval cross section 18 provided with a throat forming a groove 13 toward each of the ends of the short axis of the cross section.

Figure 4:
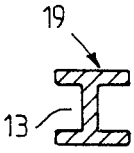

FIG. 4 corresponds to an H-shaped cross section 19, which is preferably rotated by 90°, and which also includes two grooves 13.

Figure 5:
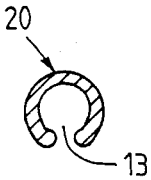

FIG. 5 corresponds to a C-shaped cross section 20, where the open part of the C is rotated toward the bottom; a cross section of this type includes only a single groove, located in the concave space of the C.

Figure 6:
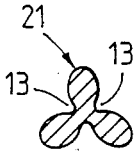
Figure 7:
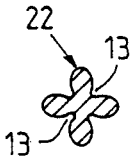
Figure 8:
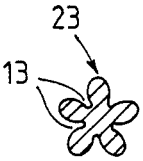

FIG. 6, 7 and 8 correspond to a trelobal or trilobal cross section 21, tetralobal cross section 22 and pentalobal cross section 23, which include three, four and five grooves 13, respectively.

The areas and dimensions of the cross sections may be different; in particular, the diameter of the circle circumscribed by the cross sections in question may be different.

Moreover, the material selected, typically a polymer, for the various bristles may also be different. In particular, a material of greater or lesser hardness may be selected. In the case of a bristle in which the area of the cross section is small, a relatively hard material can be selected, because the bristle remains flexible because of its small cross section; on the other hand, if the area of the cross section is relatively large and if the material selected is relatively hard, the bristle risks losing the flexibility required in cosmetics to prevent any danger to the user. For a bristle of relatively large cross section, a material that softens when it is dipped into the product to be applied will therefore be selected. It should be noted that for bristles having a relatively large cross-sectional area, which corresponds to a diameter of the circle circumscribed by the large cross section, a soft material cannot be used, because such bristles of large cross section, made of soft material, would be difficult to cut correctly.

As an example of a material capable of softening in the product, polyamide 6 can be named, with which an increase in flexibility of the bristle is obtained as a consequence of an increase in moisture content when it is dipped into the mascara composition. If a mixture of cross-shaped or tetralobal bristles is used, for example, being 0.17 mm in diameter and one-half is of polyamide 6 (PA 6) and the other half is of polyamide 11 (PA 11), then a brush will be obtained that after being dipped into the container of product will have some hard bristles and some flexible bristles, even though previously the two types of bristles were of the same hardness.

Figure 10:
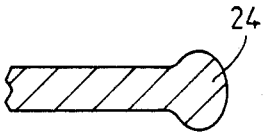
FIG. 10 is a fragmentary longitudinal section, on an enlarged scale, of the end of one bristle of the brush.

It should also be noted that depending on the shape of the cross section of the bristle and on its dimensions and material, when it is cut, the end 24 (FIG. 10) of the bristle assumes a flattened shape, comprising a bulb, depending on the dimensions and shape of the cross section and on the material. The more flattened the end 24, the more likely it is to engage an eyelash and curl it. Thus with a mixture of bristles 8*a*, 8*b* having cross sections of different shapes, variously curved eyelashes will be obtained when they are made up.

The use and function of a brush according to the invention is directly apparent from the foregoing explanation.

When the brush is immersed in the container 2 containing the product, the bristles 8*a*, 8*b* of this brush fill with the product, which is distributed substantially uniformly over the entire length of the groove 13 on the bristles.

The bristles of different cross-sectional shapes result in different amounts of the material being loaded onto the brush along the entire length of the brush and make it possible to coat the eyelashes variously thickly over the length of the eye.

When the brush is removed from the container 2, the brush is wiped by the lip 6. In the case of a standard brush, the bristles of which have identical circular cross sections, the wiping is uniform over all the bristles and in practice removes the product located on the bristles radial to the outside of a diameter corresponding substantially to that of the wiping lip; thus in a standard brush, only the region of the base of the bristles near the core of the brush remains filled with product when the brush is pulled out of the container, so that it is difficult while making up to put the eyelashes in contact with this zone of bristles because of the spiral effect.

With a brush according to the invention, the bristles of different cross-sectional shapes are wiped and filled in a different manner, and the total filling of the brush drawn from the container will be less concentrated around the core of the brush and will depend on the dosages of the different bristles. There are different amounts of product applied to the hair at different locations on the brush.

The makeup operation is done in the standard manner, but because of the existence of the spaces 15 (FIG. 9) between the bristles 8*a*, 8*b*, the eyelashes 16 are capable of penetrating into these spaces and they scrape off the variously filled bristles 8*a*, 8*b*, in particular at the level of their grooves. A new way of making up is thus obtained.

Moreover, because of the more or less flattened ends 24 (FIG. 10), the eyelashes of the same eye will be variously curled because of the mixture of bristles.

It is clear that the mixture of bristles 8*a*, 8*b* according to the invention can be provided over only part of the brush or over its entire length. Moreover, this mixture may be different in different zones of the brush, to compensate for the different efficiency of wiping over a frustoconical brush, where the diameter varies between the two ends of the brush, as can be seen in FIG. 1.

It will be understood that the number of different cross-sectional shapes may be greater than two.

Depending on the shape of the cross sections selected for the bristles, brushes can be created that fill with a predetermined variably large quantity of product, so that brushes for conspicuous makeup or brushes for subdued makeup can be obtained, for example.

What is claimed is:

1. A brush for applying a makeup product, in particular for applying mascara to the eyelashes or a dye to the hair, including a plurality of bristles held between the spirals of at least two branches of a helically twisted metal wire that forms the core defining the longitudinal axis of the brush, wherein over at least a portion of a brush, some of said bristles are provided at the surface thereof with at least one groove extending substantially from the base to the tip of said respective bristles, and some of said plurality of bristles having cross sections which have different shapes from that of other of said bristles, so that said plurality of bristles comprise at least two types, and that the bristles, having different cross-sectional shapes, are spaced apart along said axis of the core, and that a space exists between the bristles to permit the penetration of the eyelashes or hair, the bristles of different cross-sectional shapes resulting in filling of different amounts of the product along the brush, some of said bristles having a cross section area larger than other of said bristles and the bristles having a cross section of larger area being made of a material capable of softening when it is dipped into the product intended to be spread by the brush.

2. A brush as defined by claim 1, wherein the brush is provided, over its entire length, with bristles, the cross sections of which have different shapes.

3. A brush as defined by claim 1 or 2, wherein the bristles of each type of different cross-sectional shapes are made of different materials.

4. A brush as defined by claims 1 or 2, wherein areas of the cross sections of different shapes are themselves different.

5. A brush as defined by claim 1, wherein the material capable of softening when it is dipped into the product comprises polyamide 6.

6. A container for a makeup product, wherein it is equipped with a brush as defined by claims 1 or 2.

7. A brush as defined by claims 1 or 2, wherein the shape of different cross sections, at least two in number, is trilobal.

8. A brush as defined by claims 1 or 2, wherein the shape of different cross sections, at least two in number, is tetralobal.

9. A brush as defined by claims 1 or 2, wherein the shape of different cross sections, at least two in number, is pentalobal.

10. A brush as defined by claims 1 or 2, wherein the shape of different cross sections, at least two in number, is C shaped.

11. A brush as defined by claims 1 or 2, wherein the shape of different cross sections, at least two in number, is I shaped.

12. A brush as defined by claims 1 or 2, wherein the shape of different cross sections, at least two in number, is H shaped.

13. A brush as defined by claims 1 or 2, wherein the shape of different cross sections, at least two in number, is oval shaped having large and small axis and is provided with a throat at the ends of said small axis.

* * * * *